US008303314B2

(12) United States Patent
Wu

(10) Patent No.: US 8,303,314 B2
(45) Date of Patent: Nov. 6, 2012

(54) CABLE ASSEMBLY WITH ONE CABLE COUPLED TO DUAL INTERFACES AND METHODE OF MAKING THE SAME

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 217 days.

(21) Appl. No.: 12/903,233

(22) Filed: Oct. 13, 2010

(65) Prior Publication Data

US 2011/0086548 A1 Apr. 14, 2011

(30) Foreign Application Priority Data

Oct. 13, 2009 (CN) ..... 2009 1 0308221

(51) Int. Cl.
*H01R 12/24* (2006.01)

(52) U.S. Cl. ..... 439/76.1; 29/860

(58) Field of Classification Search ..... 439/76.1, 439/77, 493; 29/857, 860, 854
See application file for complete search history.

(56) References Cited

U.S. PATENT DOCUMENTS 2,932,810 A * 4/1960 Novak ..... 439/61
3,740,698 A * 6/1973 Jerominek ..... 439/61
3,751,801 A * 8/1973 Praeger et al. ..... 29/860
3,924,916 A * 12/1975 Venaleck ..... 439/76.1
4,157,612 A * 6/1979 Rainal ..... 29/828
4,255,853 A * 3/1981 Campillo et al. ..... 29/843
4,295,696 A * 10/1981 Gray ..... 439/55
4,639,054 A * 1/1987 Kersbergen ..... 439/59
4,682,828 A * 7/1987 Piper et al. ..... 439/92
4,871,319 A * 10/1989 Babow ..... 439/77
5,114,364 A * 5/1992 Hunter ..... 439/497
5,122,065 A * 6/1992 Dudek et al. ..... 439/76.1
5,190,471 A * 3/1993 Barile et al. ..... 439/455
5,580,271 A * 12/1996 Buchheister et al. ..... 439/493
5,679,008 A * 10/1997 Takahashi et al. ..... 439/76.1
5,810,620 A * 9/1998 Kobayashi et al. ..... 439/607.41
5,873,743 A * 2/1999 Tkazyik et al. ..... 439/76.1
6,109,976 A * 8/2000 van Zanten et al. ..... 439/689
6,190,196 B1 * 2/2001 Kato ..... 439/493
6,283,792 B1 * 9/2001 Tolmie et al. ..... 439/607.08
6,371,805 B1 * 4/2002 Wang et al. ..... 439/581
6,447,326 B1 * 9/2002 Teach et al. ..... 439/460
6,585,528 B1 * 7/2003 Lin et al. ..... 439/76.1
6,776,658 B2 * 8/2004 Tang ..... 439/607.58
6,916,198 B2 * 7/2005 Wu et al. ..... 439/497
7,354,292 B1 4/2008 Lloyd
7,435,106 B2 * 10/2008 Su et al. ..... 439/76.1
7,485,013 B2 * 2/2009 Kuo ..... 439/731
7,540,773 B2 * 6/2009 Ko ..... 439/581
7,625,239 B1 * 12/2009 Jatou et al. ..... 439/623
7,648,372 B2 * 1/2010 Wu ..... 439/76.1
7,651,375 B2 * 1/2010 Zhu et al. ..... 439/607.41

(Continued)

*Primary Examiner* — Neil Abrams
(74) *Attorney, Agent, or Firm* — Wei Te Chung; Ming Chieh Chang

(57) ABSTRACT

An cable assembly includes an external cover; two printed circuit boards accommodated in the external cover; a cable including a plurality of wires, a metallic braiding enclosing the wires and an insulative jacket enclosing the metallic braiding, an axial slit defined in the metallic braiding and the insulative jacket of a front segment of the cable for exposing the corresponding wires outside, the corresponding wires separated into two groups of wires respectively soldered to the two printed circuit boards; an outer shielding layer enclosing the axial slit; and a shrinkable tube mounted to the outer shielding layer.

18 Claims, 14 Drawing Sheets

U.S. PATENT DOCUMENTS 7,654,831 B1 * 2/2010 Wu ..... 439/76.1
7,743,496 B2 * 6/2010 Prest ..... 29/857
7,758,374 B2 * 7/2010 Yu et al. ..... 439/493
7,803,010 B1 * 9/2010 Hwang ..... 439/497
7,857,636 B2 * 12/2010 Su et al. ..... 439/76.1
7,874,849 B2 * 1/2011 Sticker et al. ..... 439/76.1
7,896,689 B1 * 3/2011 Su et al. ..... 439/497
7,901,238 B1 * 3/2011 Muir et al. ..... 439/417
7,922,520 B2 * 4/2011 Mizukami ..... 439/493
7,938,650 B2 * 5/2011 Helmig et al. ..... 439/76.1
8,011,932 B2 * 9/2011 Bertsch et al. ..... 439/59
8,133,071 B2 * 3/2012 Huang et al. ..... 439/499
2011/0059645 A1 * 3/2011 Wu ..... 439/460
2012/0045920 A1 * 2/2012 Wu ..... 439/345
2012/0129396 A1 * 5/2012 Wang et al. ..... 439/607.01

* cited by examiner

CABLE ASSEMBLY WITH ONE CABLE COUPLED TO DUAL INTERFACES AND METHODE OF MAKING THE SAME

FIELD OF THE INVENTION

The present invention generally relates to a cable assembly, and more particularly to a cable assembly which has a cable coupled to double interfaces.

DESCRIPTION OF PRIOR ART

U.S. Pat. No. 7,354,292 issued on Apr. 8, 2008 to Lloyd discloses a cable assembly for high-speed transmitting. The cable assembly includes an upper cover and a lower cover, a printed circuit board accommodated therein, and a cable connected to the printed circuit board. The upper cover and the lower cover define two semi-circular shaped cable outlets at rear sides thereof. When the upper cover and the lower cover are assembled together, the cable is held in the cable outlets, therefore the cable is not separated from the printed circuit board easily.

With transmitting speed increasing, a single interface dose not meet requirement, and two or more cables respectively connected to two or more printed circuit boards are widely adapted. However, more cables may take up much space, as each cable should have complete structure, such as outer jacket, and other accessory mounted to the cable.

Hence, an improved cable assembly is highly desired to overcome the aforementioned problems.

SUMMARY OF THE INVENTION

Accordingly, an object of the present invention is to provide a lower profile cable assembly with one cable connected to dual interface.

Accordingly, other object of the present invention is to provide a method of making a lower profile cable assembly with one cable connected to dual interface.

In order to achieve the object set forth, a cable assembly in accordance with the present invention comprises an external cover; two printed circuit boards accommodated in the external cover; a cable including a plurality of wires, a metallic braiding enclosing the wires and an insulative jacket enclosing the metallic braiding, an axial slit defined in the metallic braiding and the insulative jacket of a front segment of the cable for exposing the corresponding wires outside, the corresponding wires separated into two groups of wires respectively soldered to the two printed circuit boards; an outer shielding layer enclosing the axial slit; and a shrinkable tube mounted to the outer shielding layer.

In order to achieve the object set forth, a method of making the cable assembly in accordance with the present invention comprises steps of providing an external cover; providing a first printed circuit board and a second printed circuit board; providing a cable, the cable having a plurality of wires, a metallic braiding enclosing the wires and an insulative jacket enclosing the metallic braiding; cutting an axial slit on the metallic braiding and the insulative jacket of a front segment of the cable, and backing the metallic braiding and the insulative jacket of the front segment of the cable to expose corresponding wires outside; separating the wires into a first group of wires and a second group of wires, and soldering the first group of wires to the first printed circuit board, and soldering the second group of wires to the second printed circuit board; merging the first group of wires and the second group of wires into one group; turning back the metallic braiding and the insulative jacket to shield the corresponding wires; assembling an outer shielding layer to the insulative jacket to enclose the axial slit; and mounting the shrinkable tube to the outer shielding layer.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
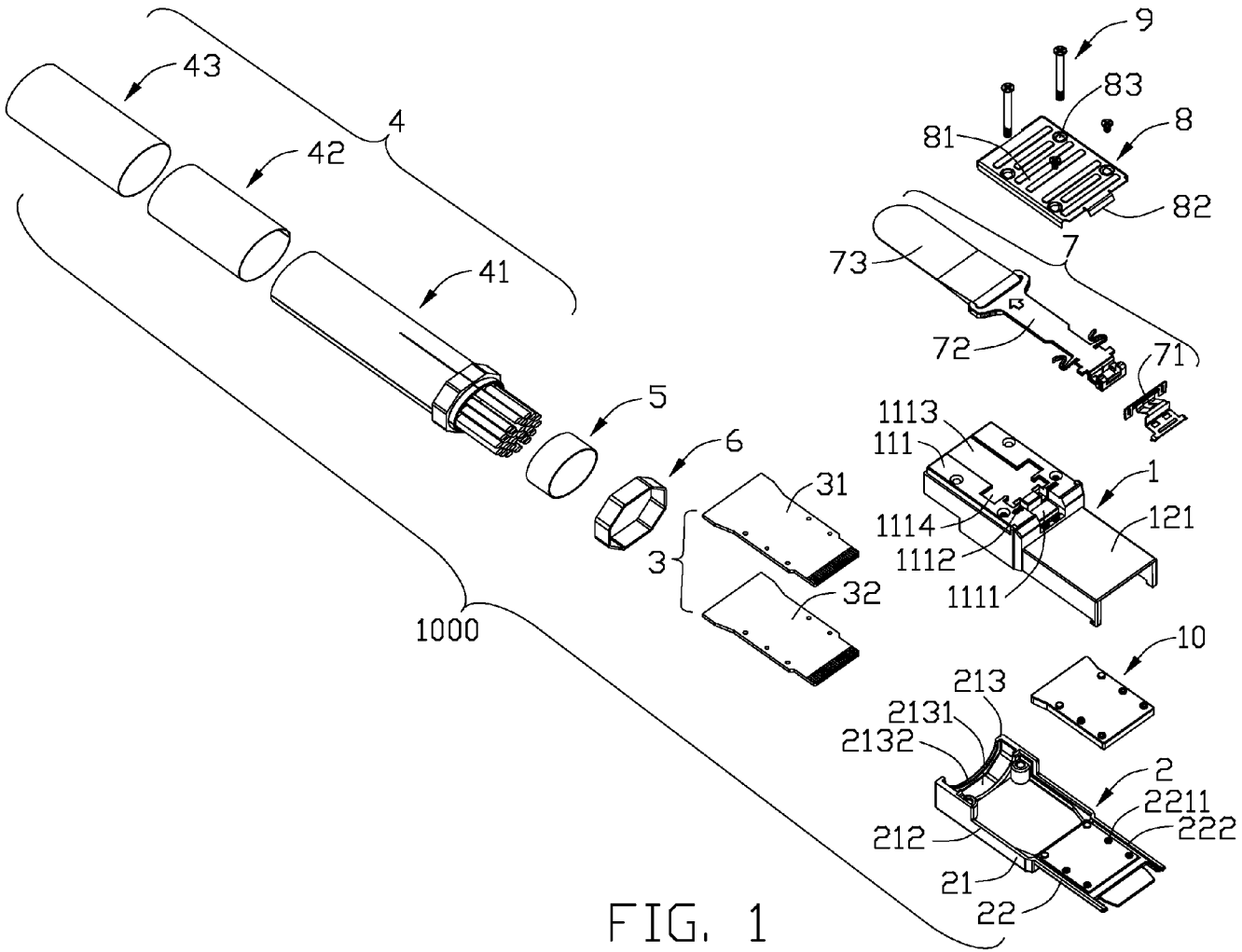
FIG. 1 is an exploded, perspective view of a cable assembly in accordance with the present invention.
Figure 2:
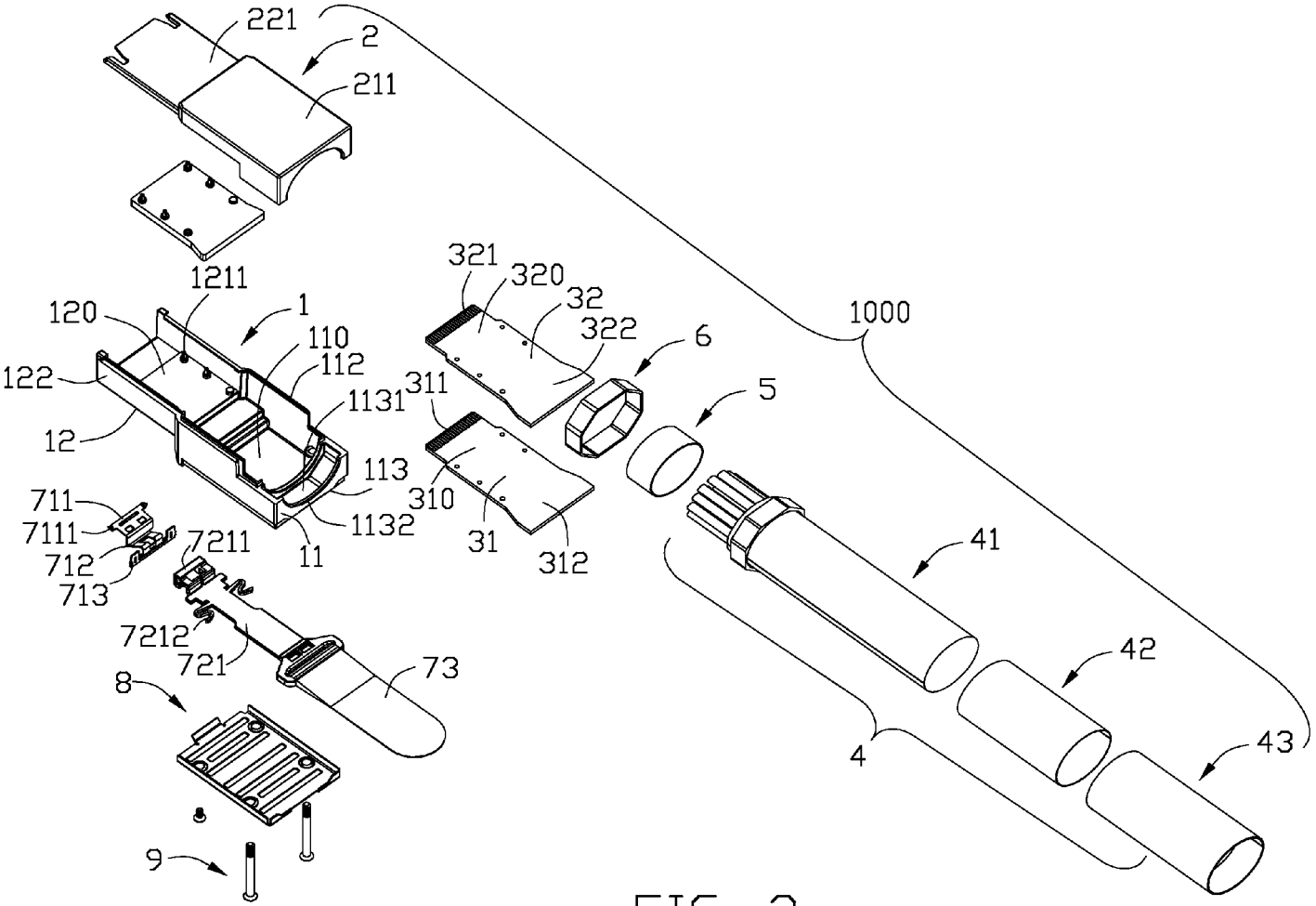
FIG. 2 is similar to FIG. 1, but viewed from another aspect.
Figure 3:
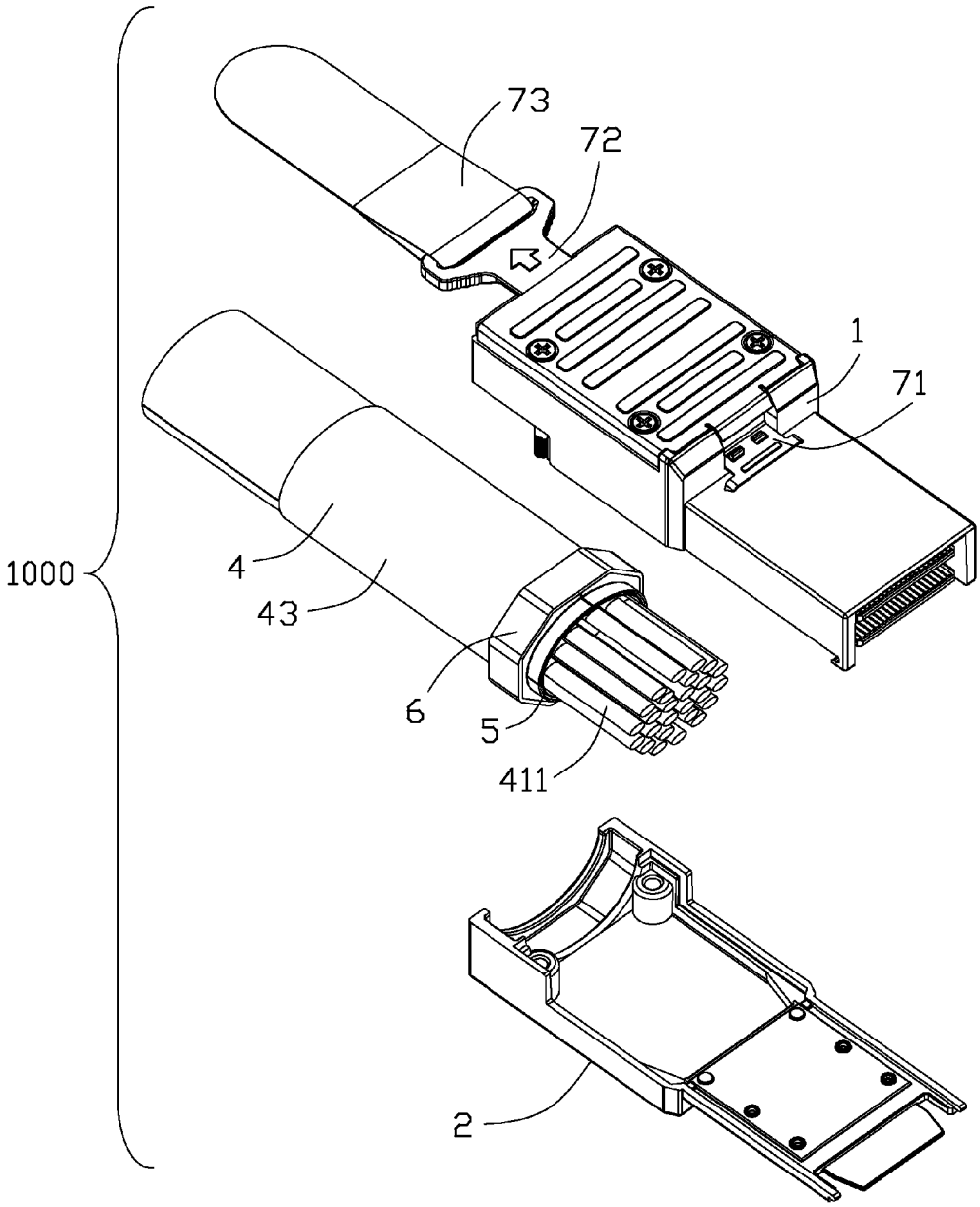
FIG. 3 is a partially assembled view of the cable assembly.
Figure 4:
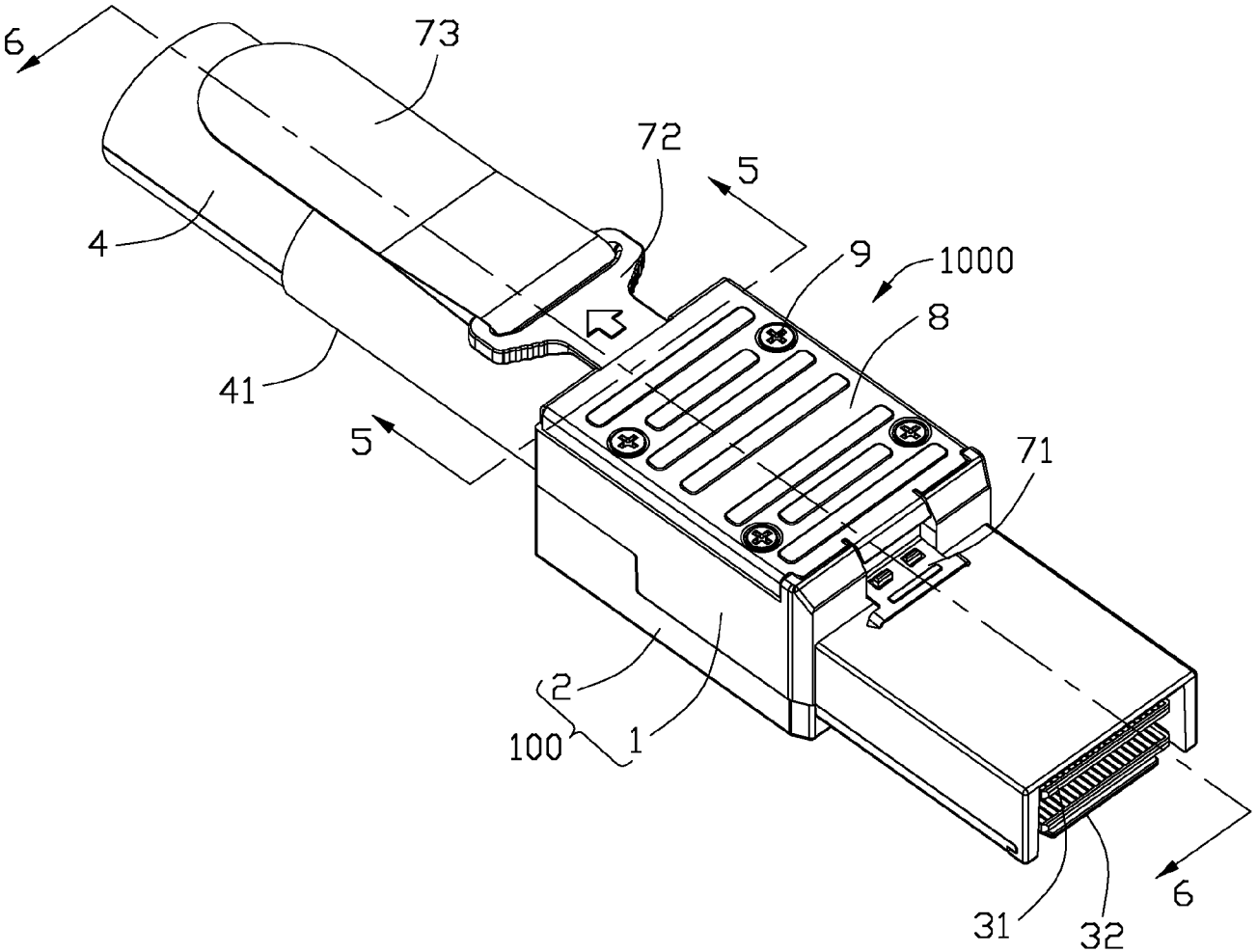
FIG. 4 is an assembled, perspective view of the cable assembly.
Figure 5:
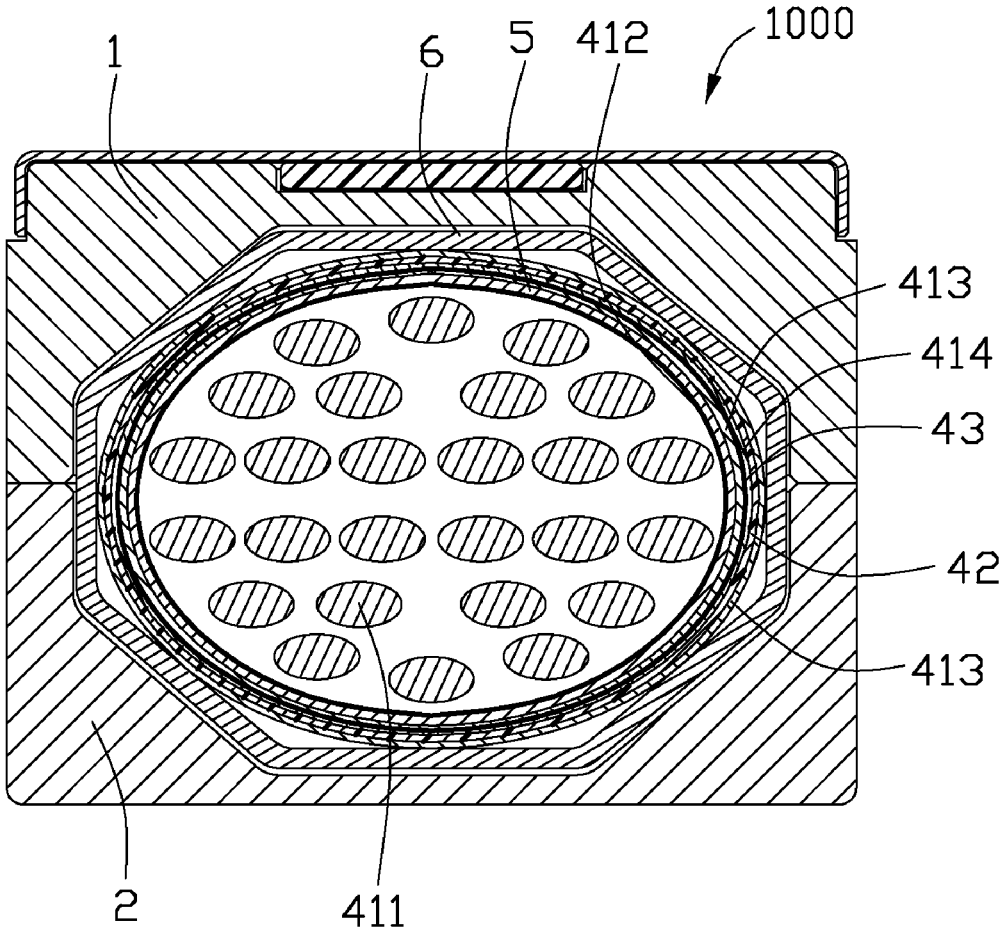
FIG. 5 is a cross-section view taken along line 5-5 of FIG. 4.
Figure 6:
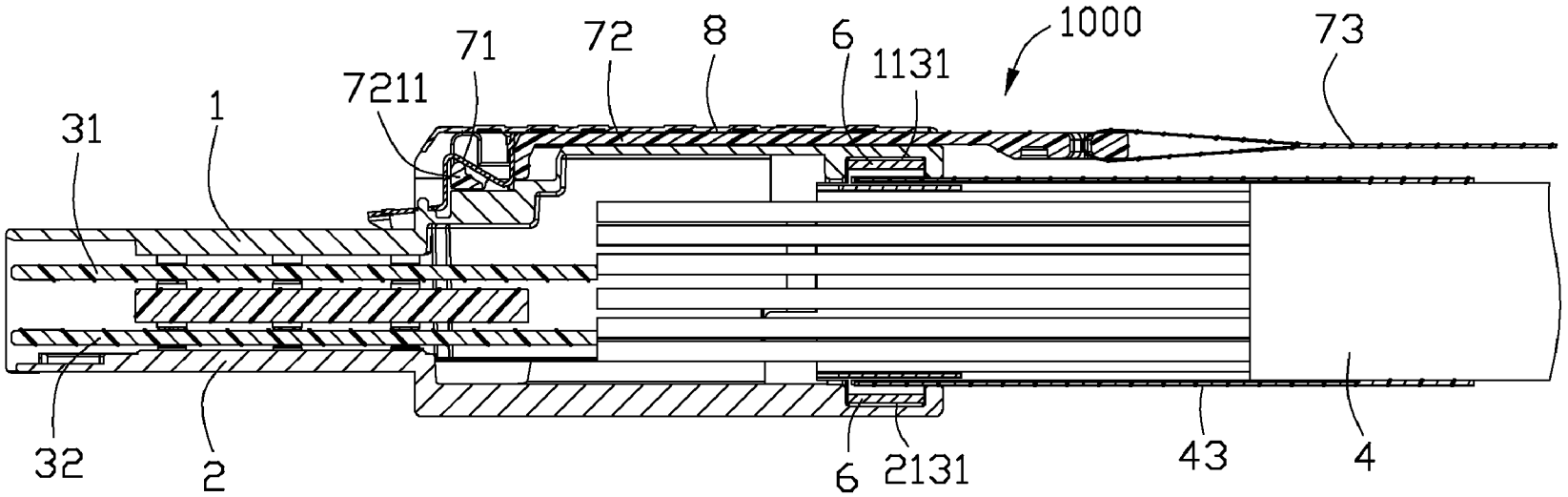
FIG. 6 is a cross-section view taken along line 6-6 of FIG. 4.

Referring to FIGS. 1-6, a cable assembly 1000 in accordance with the present invention comprises an external cover 100, two printed circuit boards 3 accommodated in the external cover 100, a cable combination 4 connected to the two printed circuit boards 3, a reinforcement member 5 inserted into a front segment of the cable combination 4, a ferrule 6 mounted to the front segment of the cable combination 4, a latching mechanism 7 assembled to the external cover 100, a cap 8 shielding the latching mechanism 7 and four screws 9 for fastening the external cover 100 and the cap 8.

The external cover 100 includes a first cover 1 and a second cover 2 combined together. Both of the first cover 1 and the second cover 2 are made of metallic material.

The first cover 1 has a base portion 11 and a mating portion 12 extending forwardly from the base portion 11. The base portion 11 has a top wall 111, two lateral walls 112 downwardly projecting from lateral edges of the top wall 111, and a back wall 113 downwardly projecting from a rear edge of the top wall 111. The top wall 111 and the two lateral walls 112 and the back wall 113 together form a first hollow 110. There is a retaining cavity 1131 defined in a middle segment of the back wall 113 and an outlet 1132 are defined in a front and a back segments of the back wall 113. The outlet 1132 communicate with the retaining cavity 1131. The mating portion 12 has an upper wall 121 and two side walls 122 extending downwardly from lateral edges of the upper wall 121. The upper wall 121 and two side walls 122 together form a second hollow 120. The first hollow 110 and the second hollow 120 communicate with each other. The first hollow 110 is larger than the second hollow 120. In addition, there are several positioning posts 1211 located inside the second hollow 120. A recess 1111 is defined in a front segment of an outer side of the top wall 111. A channel 1113 is defined in a back segment of the outer side of the top wall 111. The channel 1113 communicates with the recess 1111. There is a slit 1112 located in the front segment of the outer side of the top wall 111 and behind the recess 1111. The slit 1112 communicates with the recess 1111. There are two grooves 1114 located in two sides of a front portion of the channel 1113 and communicate with the channel 1113.

The second cover 2 includes a main portion 21 and a tongue portion 22 extending forwardly from the main portion 21. The main portion 21 has a bottom wall 211 and two flanges 212 formed at lateral sides of the bottom wall 211. In addition, there is also a back wall 213 upwardly protruding from rear side of the bottom wall 211. There is a retaining cavity 2131 defined in a middle segment of the back wall 213 and an outlet 2132 are defined in a front and a back segments of the back wall 113. In addition, there are two protrusions 222 formed at each lateral edge of the tongue portions 22. Several standoffs 2211 are located on the tongue portion 22 and located aside the two protrusions 222.

The printed circuit boards 3 includes a first printed circuit board (PCB) 31 and a second PCB 32. There are several first conductive pads 311 formed on a front segment 310 of the first PCB 31, and there are also several second conductive pads 321 formed on a front segment of the second PCB 32. The first PCB 31 and the second PCB 32 are mounted into the first cover 1, with the front segments 310, 320 located in the second hollow 120, while rear segments 312, 322 of the first and second PCBs 31, 32 located in the first hollow 110. In addition, there is a spacer 10 disposed between the first PCB 31 and the second PCB 32 so as to separate them from each other along a up-to-down direction.

The cable combination 4 includes a cable 41 which has a number of wires 411, an inner shielding layer 412 shrouding the wires 411, a metallic braiding 413 enclosing the inner shielding layer 412 and an insulative jacket 414 enclosing the metallic braiding 413. The inner shielding layer 412 can be aluminum foil and other similar structure. The wires 411 of the cable combination 4 are separated into two groups and connected to the rear segments 312, 322 of the first and second PCBs 31, 32. In addition, there is an outer shielding layer 42 enclosing the insulative jacket 414 of the front segment of the cable 41 and a shrinkable tube 43 enclosing/attached to the outer shielding layer 42. The outer shielding layer 42 is made of conductive material which can suppress EMI.

Figure 7A:
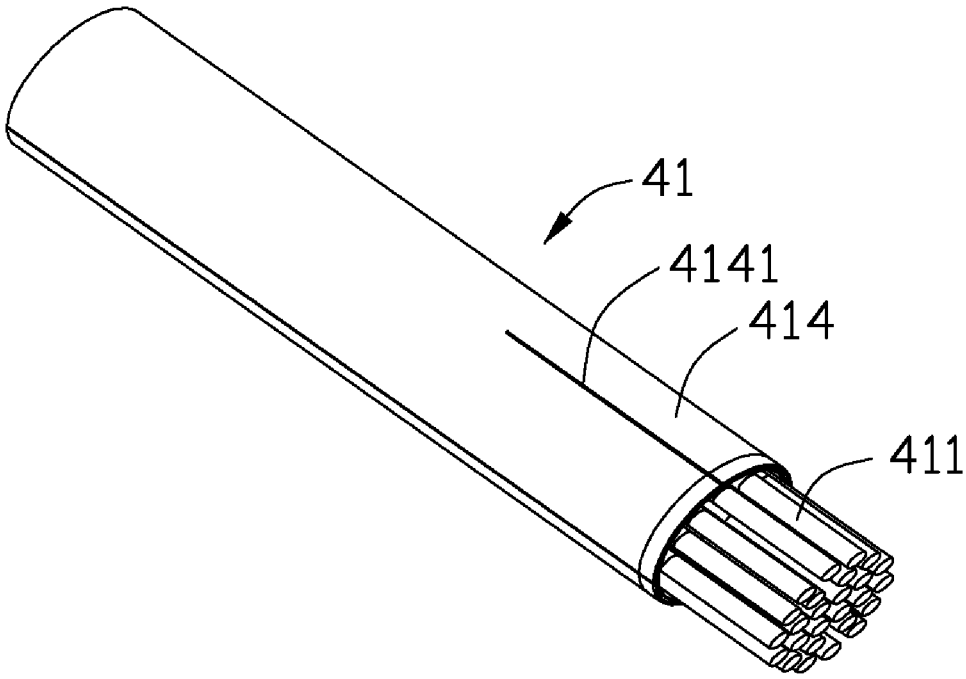
FIGS. 7A-7H show steps of connecting a cable to two printed circuit boards.
Figure 7B:
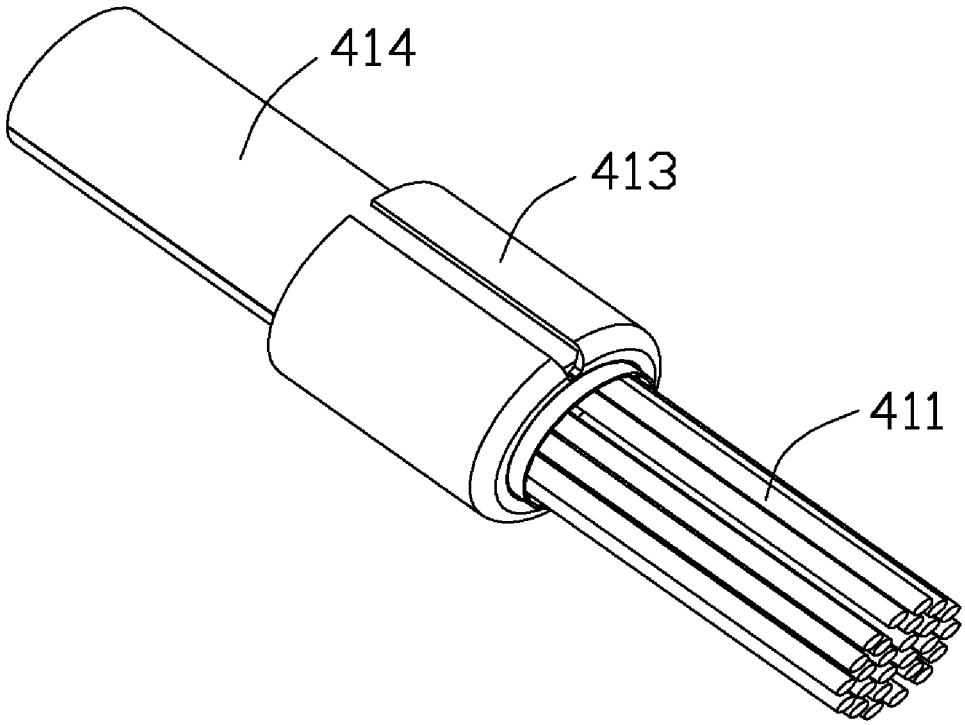
Figure 7C:
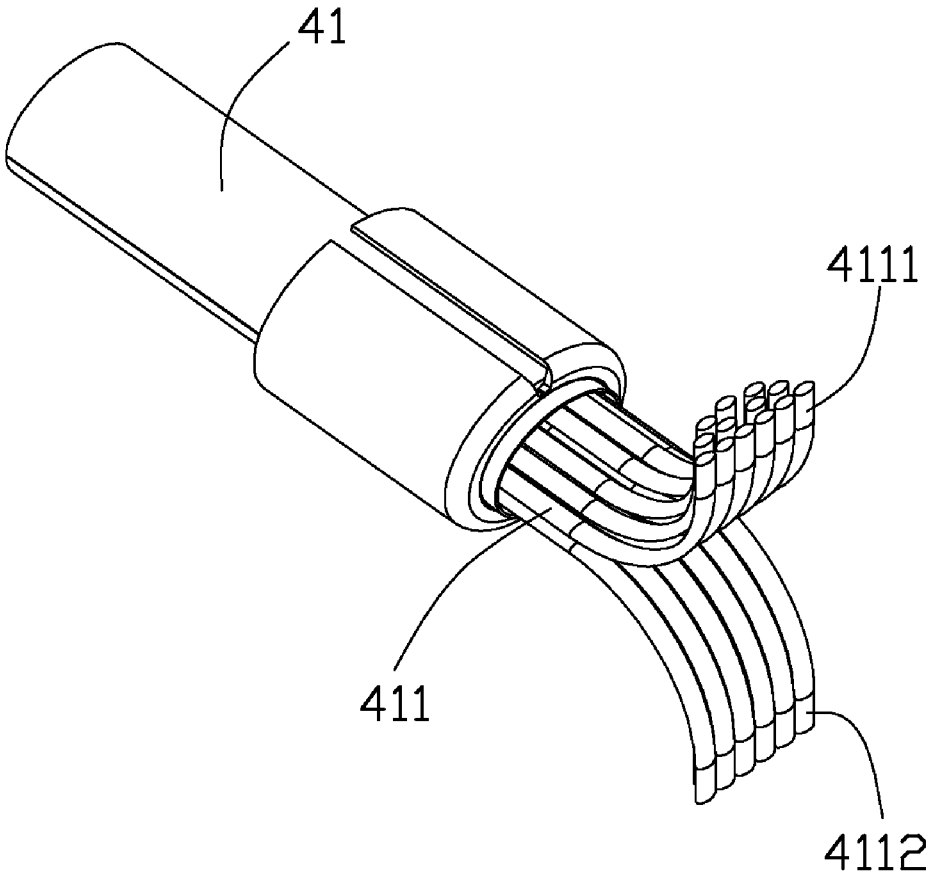
Figure 7D:
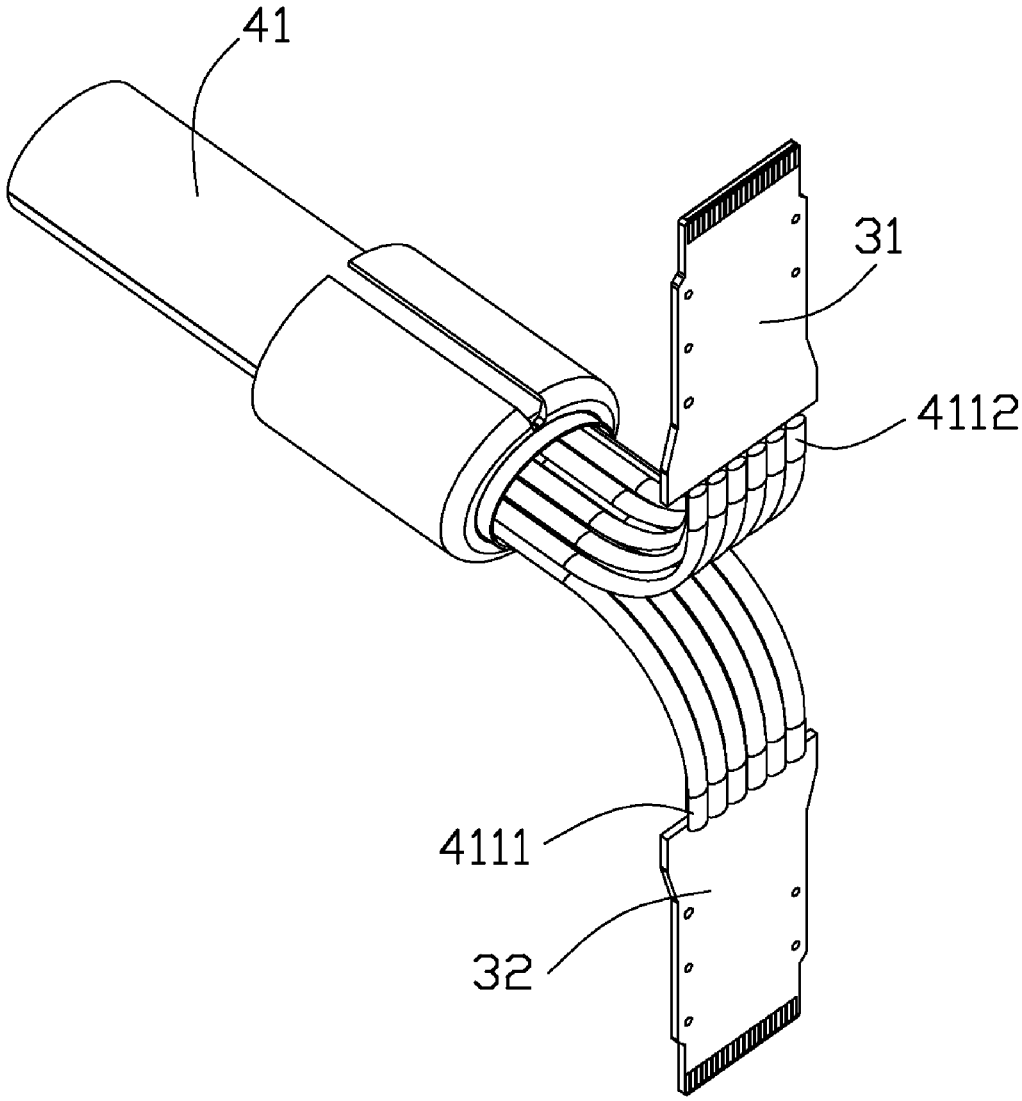
Figure 7E:
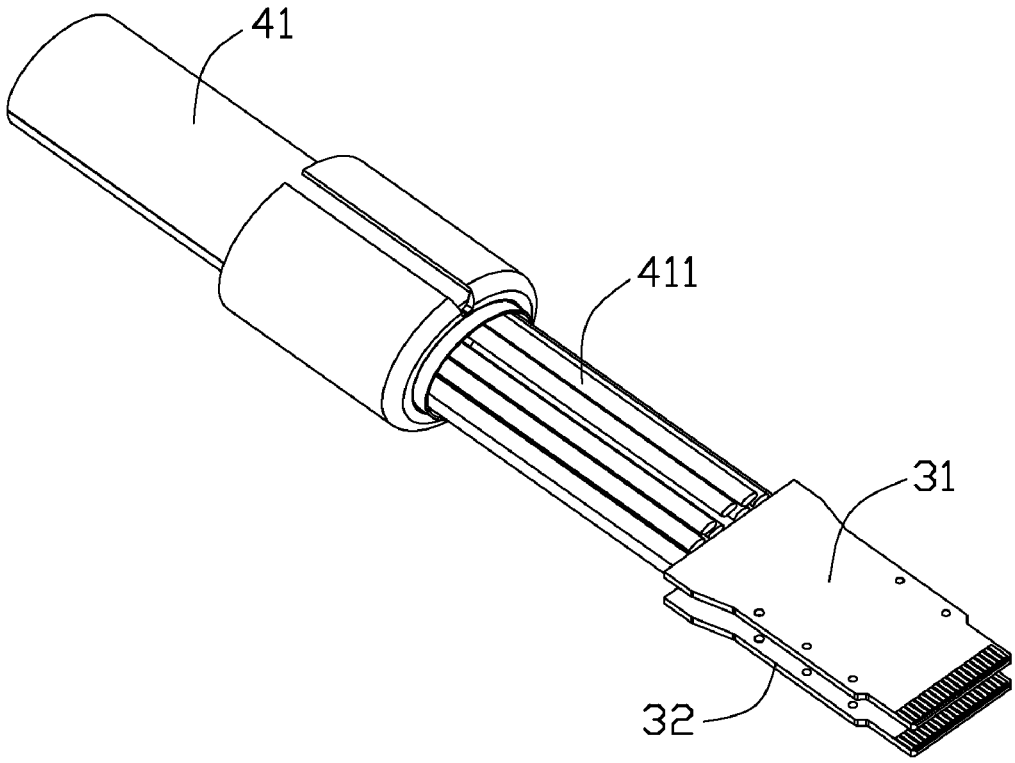
Figure 7F:
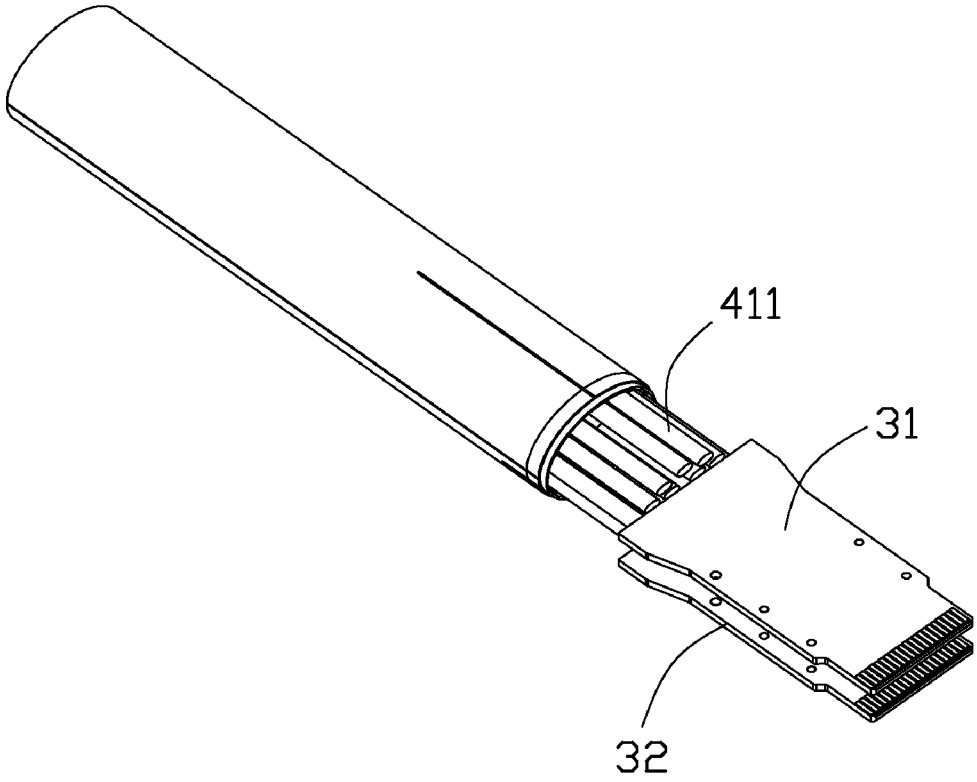
Figure 7G:
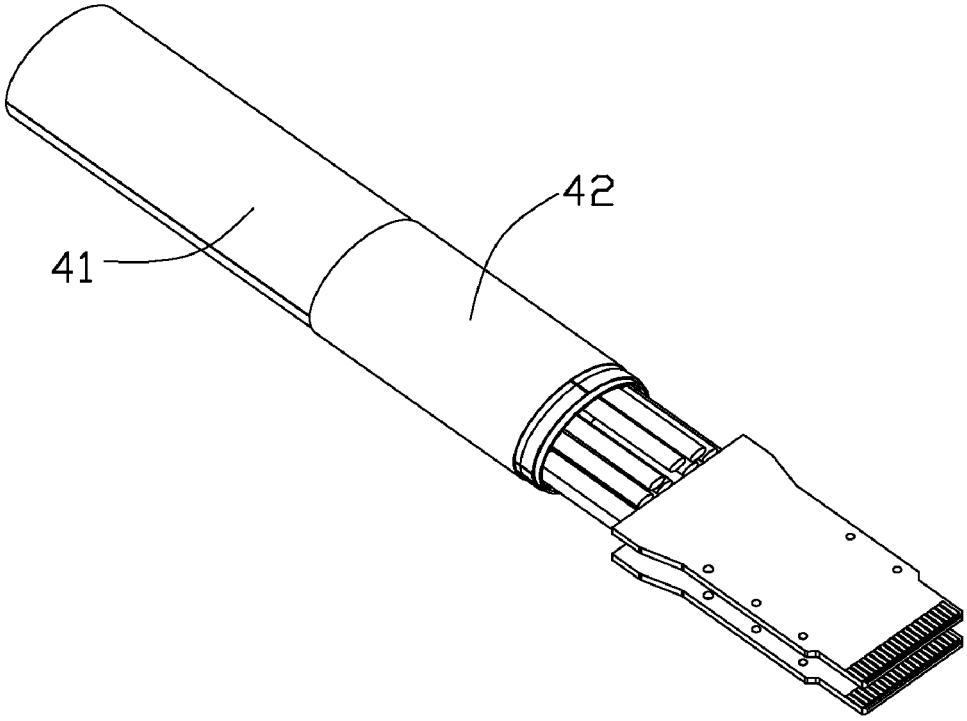
Figure 7H:
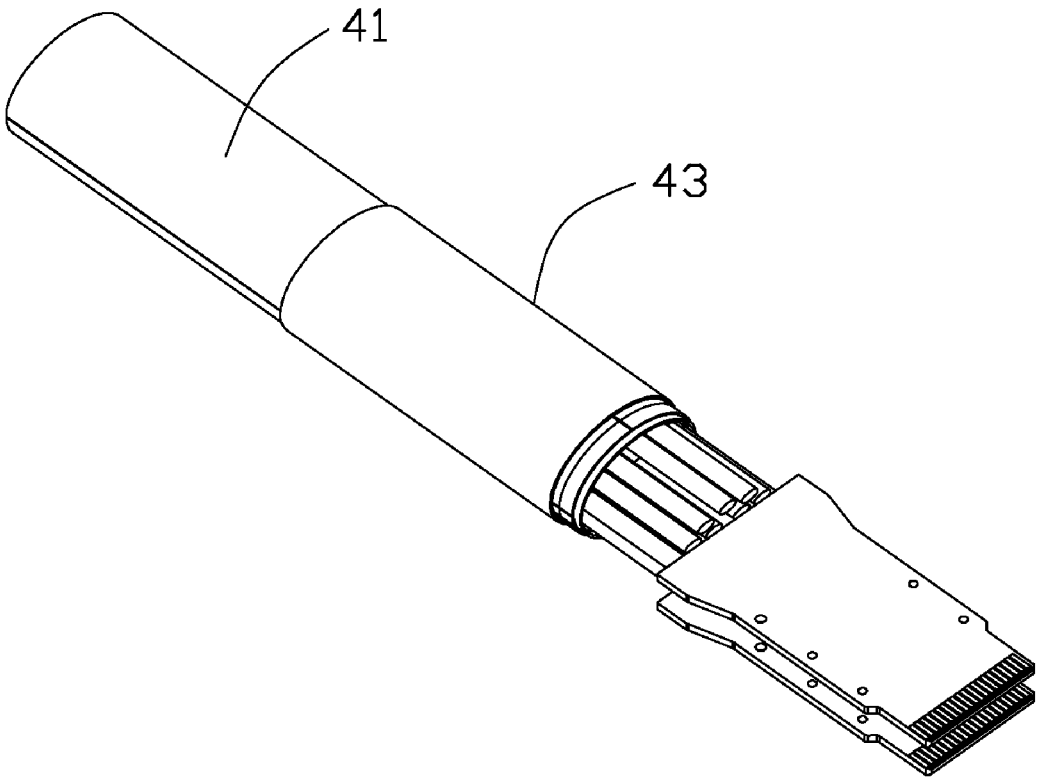

Referring to FIGS. 7A-7H, a method of making the cable assembly 100 comprises following main steps:

Providing the external cover 100;

Providing a first printed circuit board 31 and a second printed circuit board 32;

Providing the cable 41, stripping partial of the inner shielding layer 412, the metallic braiding 413 and the insulative jacket 414 to expose the wires 411 outside;

Cutting an axial slit 4141 on a part of metallic braiding 413 and the insulative jacket 414 of a front segment of the cable 41, and backing the part of metallic braiding 413 and the insulative jacket 414 to expose corresponding wires 411 outside;

Separating the wires 411 into a first group of wires 4111 and a second group of wires 4112, and front ends of the first group of wires 4111 being outwardly bent ninety degrees regarding to an axis of the cable 41, and front ends of the second group of wires 4112 being outwardly bent ninety degrees regarding to the axis of the cable 41;

Soldering the front ends of the first group of wires 4111 to the first printed circuit board 31, and soldering the front ends 4112 of the second group of wires 4112 to the second printed circuit board 32;

Merging the first group of wires 4111 and the second group of wires 4112 into one group;

Turning back the part of metallic braiding 413 and the insulative jacket 414 to shield the corresponding wires 411;

Assembling the outer shielding layer 42 to the part of the insulative jacket 414 to enclose the axial slit 4141 therein;

Mounting the shrinkable tube 43 to the outer shielding layer 42.

The reinforcement member 5 is a pipe or ring shaped member, which is made of metallic material or other hard materials. The reinforcement member 5 has a passage (not numbered) extending along axially direction thereof. The reinforcement member 5 is arranged outside of the shielding member 412, inside of the metallic braiding 413 of the front segment of the cable 41. The wires 411 pass through the reinforcement member 5.

The ferrule 6 is also a ring/loop shaped member which is made of metallic material mounted to the front segments of the cable combination 41. In addition, a portion of the metallic braiding 413 exposed outside of a front end of the jacket 414 is turned back and encircles a front segment of the outer shielding layer 42 and the shrinkable tube 43. The ferrule 6 is crimped to the portion of the metallic braiding 413, a corresponding part of the front segment of the outer shielding layer 42 and the shrinkable tube 43 and the corresponding insulative jacket 414 and further encircles the reinforcement member 5, therefore, the metallic braiding 413 is sandwiched between the reinforcement member 5 and the ferrule 6. In alternative embodiment, the ferrule 6 is directly crimped to an outside of the insulative jacket 414 and encircles the reinforcement member 5 to sandwich the metallic braiding 413 inside the corresponding insulative jacket 414. The reinforcement member 5 is used for preventing shielding layer 412 and the wires 411 from being destroyed or deformed excessively. The ferrule 6 is retained in retaining cavities 1131, 2131 of the back walls 113, 213. Therefore, the cable combination 4 is connected to the external cover 100 reliably.

The latching mechanism 7 includes a latching member 71, an actuating member 72 and a pulling tape 73.

The latching member 71 has a L-shaped main portion 711, an engaging portion 713 and an inclined connecting portion 712 linking the main portion 711 and the engaging portion 713. Two hooks 7111 are formed at lateral sides of the main portion 711, respectively. The engaging portion 713 is located in a vertical plane. The actuating member 72 includes a stretched body portion 721, an actuating portion 7211 formed at a front end thereof, two elastic portions 7212 formed at lateral sides of a front segment of the actuating portion 7211. The pull tape 73 is attached to a back segment of the actuating portion 7211.

The actuating member 72 is mounted to the first cover 1, with the body portion 721 accommodated in the channel 1113 and capable of sliding therein along a front-to-back direction, the actuating portion 7211 accommodated in the recess 1111, the engaging portion 713 interferentially assembled into the slit 1112. The connecting portion 712 is disposed above the actuating portion 7211.

The cap 8 includes a main part 81, a tab 82 protruding downwardly and forwardly from a front edge of the main part 81. There are four holes 83 defined in the main port 81. The cap 8 is mounted to the base portion 11 of the first cover 1 to shield the actuating member 72 and the latching member 71. In addition, the tab 82 is located above the main portion 711 of the latching member 71. The screws 9 are assembled to the first cover 1 and the second cover 2 via holes 83 defined in the cap 8.

When the cable assembly 1000 mating with a complementary connector (not shown), the hooks 7111 of the latching member 71 locking into latching holes (not shown) of the complementary connector, therefore the cable assembly 1000 and the complementary connector can securely combined together. When separating the cable assembly 1000 from the complementary connector, just exerting a pulling force to the pulling member 73 to rearwardly move the actuating member 72, and the actuating portion 7211 slides along the connecting portion 712 to bring it flip upwardly. Therefore, the hooks 7111 detach from latching holes of the complementary connector. The elastic portions 7212 can provide a restore force to push the actuating member 72 to its original position. The tab 82 can urge the latching portion 71 to its original position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an external cover;

two printed circuit boards accommodated in the external cover;

a cable including a plurality of wires, a metallic braiding enclosing the wires and an insulative jacket enclosing the metallic braiding, an axial slit defined in the metallic braiding and the insulative jacket of a front segment of the cable for exposing the corresponding wires outside, the corresponding wires separated into two groups of wires respectively soldered to the two printed circuit boards;

an outer shielding layer enclosing the axial slit; and a shrinkable tube mounted to the outer shielding layer.

2. The cable assembly as recited in claim 1, wherein there is an inner shielding layer shrouding the wires and further enclosed within the metallic braiding.

3. The cable assembly as recited in claim 2, wherein there is reinforcement member arranged between the inner shielding layer and the metallic braiding of the front segment of the cable.

4. The cable assembly as recited in claim 3, wherein there is a ferrule crimped to the insulative jacket of the front segment of the cable and encircling the reinforcement member, and the metallic braiding is sandwiched between the reinforcement member and the ferrule.

5. The cable assembly as recited in claim 4, wherein the ferrule is retained in a retaining cavity which is defined in a back wall of the external cover.

6. The cable assembly as recited in claim 1, wherein the external cover includes a first cover and a second cover assembled together.

7. The cable assembly as recited in claim 6, wherein the retaining cavity is defined in the back wall of the first cover and the back wall of the second cover.

8. The cable assembly as recited in claim 1, wherein the external cover is made of metallic material.

9. The cable assembly as recited in claim 1, wherein the outer shielding layer is made of conductive material.

10. A method of making a cable assembly, comprising steps of:

providing an external cover;

providing a first printed circuit board and a second printed circuit board;

providing a cable, the cable having a plurality of wires, a metallic braiding enclosing the wires and an insulative jacket enclosing the metallic braiding;

cutting an axial slit on the metallic braiding and the insulative jacket of a front segment of the cable, and backing the metallic braiding and the insulative jacket of the front segment of the cable to expose corresponding wires outside;

separating the wires into a first group of wires and a second group of wires, and soldering the first group of wires to the first printed circuit board, and soldering the second group of wires to the second printed circuit board;

merging the first group of wires and the second group of wires into one group;

turning back the metallic braiding and the insulative jacket to shield the corresponding wires;

assembling an outer shielding layer to the insulative jacket to enclose the axial slit; and mounting a shrinkable tube to the outer shielding layer.

11. The method of making the cable assembly as recited in claim 10, wherein front ends of the first group of wires are outwardly bent ninety degrees regarding to an axis of the cable, and front ends of the second group of wires are outwardly bent ninety degrees regarding to the axis of the cable.

12. The method of making the cable assembly as recited in claim 10, further comprising a step of stripping partial of the metallic braiding and the insulative jacket to expose the wires outside.

13. An electrical cable connector assembly comprising:

a cover defining a mating port on a front portion thereof;

a printed circuit board received in the cover and defining a front portion forwardly communicating with the mating port, and rear portion defining a plurality of conductive pads thereon;

a round cable including a bundle of wires each including an inner conductor and an outer insulator, a braiding layer enclosing said bundle of wires, an insulative jacket enclosing said braiding layer, a front portion of the insulative jacket and a front portion of the braiding layer splitting off so as not to restrain the enclosed wires but allowing said wires to be transversely spread in a plane for soldering to the corresponding conductive pads, and an outer metallic shielding layer enclosing the front portion of the insulative jacket, only after the wires are soldered to the conductive pads, to reinforce not only electrical shielding of said braiding layer for making up for leak due to splitting of said braiding layer but also mechanical shielding of said insulative jacket for making up for breakage due to splitting of said insulative jacket.

14. The electrical cable connector assembly as claimed in claim 13, further including an insulative shrinkable tube encloses said outer shielding layer once said outer shielding layer is applied to the front portion of the insulative jacket.

15. The electrical cable connector assembly as claimed in claim 13, wherein a reinforcement member is inserted axially and sandwiched radially between the braiding layer and the bundle of wires around said front portions of the braiding layer and the front portion of the insulative jacket, and a ferrule is crimped upon the front portion of the insulative jacket so as to cooperate with the reinforcement member to sandwich the front portion of the braiding layer and the front portion of the insulative jacket therebetween radially.

16. The electrical cable connector assembly as claimed in claim 15, wherein a front end section of the braiding layer is exposed upon an exterior and backwardly folded upon the front portion of the insulative jacket while being sandwiched between the ferrule and the front portion of the insulative jacket.

17. The electrical cable connector assembly as claimed in claim 16, wherein said outer shielding layer is offset from the ferrule and the reinforcement member axially.

18. The electrical cable connector assembly as claimed in claim 13, wherein a front portion of the printed circuit board extends into the mating port and forms a mating part for coupling to a complementary connector.

* * * * *